US011455878B2

(12) United States Patent
Friedman

(10) Patent No.: US 11,455,878 B2
(45) Date of Patent: Sep. 27, 2022

(54) PROTECTED SECURITY STRAP

(71) Applicant: ATTENTI ELECTRONIC MONITORING LTD., Tel Aviv (IL)

(72) Inventor: Ofer Friedman, Ganei-Tikva (IL)

(73) Assignee: ATTENTI ELECTRONIC MONITORING LTD., Tel Aviv (IL)

( * ) Notice: Subject to any disclaimer, the term of this patent is extended or adjusted under 35 U.S.C. 154(b) by 101 days.

(21) Appl. No.: 16/975,127

(22) PCT Filed: Feb. 26, 2020

(86) PCT No.: PCT/IL2020/050220
§ 371 (c)(1),
(2) Date: Aug. 23, 2020

(87) PCT Pub. No.: WO2020/174474
PCT Pub. Date: Sep. 3, 2020

(65) Prior Publication Data

US 2021/0201650 A1 Jul. 1, 2021

Related U.S. Application Data

(60) Provisional application No. 62/810,512, filed on Feb. 26, 2019.

(51) Int. Cl.
*A44C 5/02* (2006.01)
*G08B 21/02* (2006.01)
(Continued)

(52) U.S. Cl.
CPC ..... *G08B 21/22* (2013.01); *A44C 5/0007* (2013.01); *A44C 5/025* (2013.01);
(Continued)

(58) Field of Classification Search
CPC .... G08B 21/22; G08B 21/0286; G08B 25/10; G08B 21/182; G08B 29/046;
(Continued)

(56) References Cited

U.S. PATENT DOCUMENTS 5,471,197 A 11/1995 McCurdy et al.
7,382,268 B2 * 6/2008 Hartman ..... G08B 21/0269 340/539.1
(Continued)

FOREIGN PATENT DOCUMENTS

EP 3382664 A1 10/2018
GB 2501909 A 11/2013
WO 2016/164994 A1 10/2016

*Primary Examiner* — John A Tweel, Jr.
(74) *Attorney, Agent, or Firm* — Soroker—Agmon—Nordman; Daniel Schatz; Shaone Godesh

(57) ABSTRACT

A tracking device, including a communication interface encased in a encasement with a receptacle on two opposite sides of the encasement, a strap, including one or more thin elongated flexible sheets, links coupled to one side of the one or more thin elongated flexible sheets, a fiber optic cable extending from a first end of the one or more thin elongated flexible sheets to a second end of the one or more thin elongated flexible sheets, a head connected to each end of the one or more thin elongated flexible sheets; wherein the heads are configured to fit into the receptacles and lock the strap in the receptacles thus preventing the strap from sliding out of the receptacles; and wherein the communication interface is configured to detect tampering with the strap by transmitting an optical signal through the fiber optic cable.

18 Claims, 9 Drawing Sheets

(51) Int. Cl.
*A44C 5/00* (2006.01)
*G08B 21/22* (2006.01)
*G08B 25/10* (2006.01)

(52) U.S. Cl.
CPC ..... *G08B 21/0286* (2013.01); *G08B 21/0288* (2013.01); *G08B 25/10* (2013.01)

(58) Field of Classification Search
CPC ... G08B 21/0288; A44C 5/025; A44C 5/0007; A44C 5/0053
See application file for complete search history.

(56) References Cited

U.S. PATENT DOCUMENTS

| | | | | |
|---|---|---|---|---|
| 9,622,552 | B2 * | 4/2017 | Pemberton ..... | A44C 5/142 |
| 2003/0174059 | A1 | 9/2003 | Reeves | |
| 2009/0051562 | A1 | 2/2009 | Potier et al. | |
| 2011/0248853 | A1 | 10/2011 | Roper et al. | |

* cited by examiner

PROTECTED SECURITY STRAP

RELATED APPLICATIONS

This application claims priority from Provisional application No. 62/810,512 filed on Feb. 26, 2019 the disclosure of which is incorporated herein by reference.

TECHNICAL FIELD

The present disclosure relates generally to a security strap for attaching a tracking device to a limb of a person and more specifically wherein the security strap is protected against tampering and cutting.

BACKGROUND

It is common practice today to attach a body worn tracking device to a person for monitoring their location and/or enforcing a location based policy such as house arrest, curfew sentencing, pre-trial sentencing, parole and probation. Typically the tracking device is attached with a strap to the ankle of the person or to other limbs, for example the wrist of the person. The person is prohibited from removing the tracking device to prevent them from violating the location based policy.

Typically the strap is designed to serve as a security strap, which is designed to make it physically hard for the person to remove the strap and/or includes tamper detection means that identify removal of the strap. Optionally, the detection means might even detect attempts to remove the strap. The tamper detection may be implemented by including a wire or fiber optic cable to close a circuit. Optionally, the wire or fiber optic cable surrounds the person's limb and is monitored by the tracking device. If the wire or fiber optic cable is cut or broken the tracking device will identify a violation and provide notification.

Likewise it is desirable that the security strap be robust so that the security strap will not be accidently broken, easily removed when desired, with standard household utensils or easily removed in an act of rage or moment of insanity. However, on the other hand comfort considerations make it desirable that the strap be lightweight and flexible and not a solid rigid band.

Thus it is desirable to form a flexible strap, with tamper means, that is not easily damaged or removed.

SUMMARY

An aspect of an embodiment of the disclosure relates to a device and method for attaching a tracking device to a person's limb. The device includes a communication interface for communicating with a server and a strap to attach the communication interface to a person's limb. The strap is designed to be detachable so that it can be reused. The device also includes a fiber optic cable to detect tampering. The strap is designed to be robust so that it cannot be easily cut, for example with home utensils or even with a bolt cutter or wire cutter. The strap includes one or more thin elongated flexible sheets with a plurality of links coupled to the sheets to form a protected channel to accommodate the fiber optic cable. The links enhance robustness of the strap, protecting the strap from being cut, and the links preserve flexibility of the strap.

In some embodiments of the disclosure, the strap includes a single sheet with interlocking links coupled to one side of the sheet. Wherein the links are arrange in two columns to form a channel for positioning the fiber optic cable. Alternatively, the strap includes two or more sheets and links coupled to one side of the sheets holding the sheets in position. Optionally, the links extend across the width of the strap and form an interlocking pattern from one end of the strap to the other. Optionally, the fiber optic cable is positioned beneath the links between the two or more sheets. In some embodiments of the disclosure, the links include tabs that extend downward to form a protected channel between the sheets to position the fiber optic cable.

In some embodiments of the disclosure, the links are covered by a protective cover, for example a rubber, plastic or silicon cover to protect the links and sheets from dirt. The protective cover may be on a single side to cover the links, or on two sides, covering the links and the sheets. Alternatively, the protective cover may cover the entire body of the strap.

There is thus provided according to an exemplary embodiment of the disclosure, a tracking device, comprising:

A communication interface encased in a encasement with a receptacle on two opposite sides of the encasement;

A strap, comprising:

One or more thin elongated flexible sheets;

Links coupled to one side of the one or more thin elongated flexible sheets;

A fiber optic cable extending from a first end of the one or more thin elongated flexible sheets to a second end of the one or more thin elongated flexible sheets;

A head connected to each end of the one or more thin elongated flexible sheets; wherein the heads are configured to fit into the receptacles and lock the strap in the receptacles thus preventing the strap from sliding out of the receptacles; and Wherein the communication interface is configured to detect tampering with the strap by transmitting an optical signal through the fiber optic cable.

In an exemplary embodiment of the disclosure, the strap includes a single thin elongated flexible sheet and the links are arranged in two rows along an elongated axis of the thin elongated flexible sheet, forming a channel between the two rows for placing the fiber optic cable between the links. Alternatively, the strap includes multiple thin elongated flexible sheets; wherein each link defines the width of the strap and is coupled to each of the multiple thin elongated flexible sheets; and wherein the links are interlocked along an elongated axis of the multiple thin elongated flexible sheets. In an exemplary embodiment of the disclosure, the links include protection tabs that extend downward from the links toward the inner circumference of the strap to form a protected channel for the fiber optic cable between the multiple thin elongated flexible sheets. Optionally, the fiber optic cable is positioned below the links toward the inner circumference of the strap between the multiple thin elongated flexible sheets.

In an exemplary embodiment of the disclosure, the strap further includes an interface connected at each end of the fiber optic cable; wherein the interface at each end is coupled to the ends of the one or more thin elongated flexible sheets and attached to a respective head. Optionally, the head at each end of the strap is coupled directly to the ends of the one or more thin elongated flexible sheets. In an exemplary embodiment of the disclosure, each head includes a latch that is configured to lock the head in the receptacle and wherein the latch is configured to also enable release of the head from the receptacle by pressing on the latch with a specially designed tool. Optionally, the links of the strap are covered by a protective cover. In an exemplary embodiment of the disclosure, the protective cover is color coded to designate a length of the strap.

There is further provided according to an exemplary embodiment of the disclosure, a method of connecting a tracking device to a limb of a person, comprising:

Receiving a communication interface encased in a encasement with a receptacle on two opposite sides of the encasement;

Receiving a strap, comprising:

One or more thin elongated flexible sheets;

Links coupled to one side of the one or more thin elongated flexible sheets;

A fiber optic cable extending from a first end of the thin elongated flexible sheets to a second end of the thin elongated flexible sheets;

A head connected to each end of the thin elongated flexible sheets;

inserting the heads of the strap into the receptacles of the communication interface to lock the straps to the communication interface and prevent the straps from sliding out of the receptacles; and Wherein the communication interface is configured to detect tampering with the strap by transmitting an optical signal through the fiber optic cable.

BRIEF DESCRIPTION OF THE DRAWINGS

The present disclosure will be understood and better appreciated from the following detailed description taken in conjunction with the drawings. Identical structures, elements or parts, which appear in more than one figure, are generally labeled with the same or similar number in all the figures in which they appear, wherein.

DETAILED DESCRIPTION

Figure 1A:
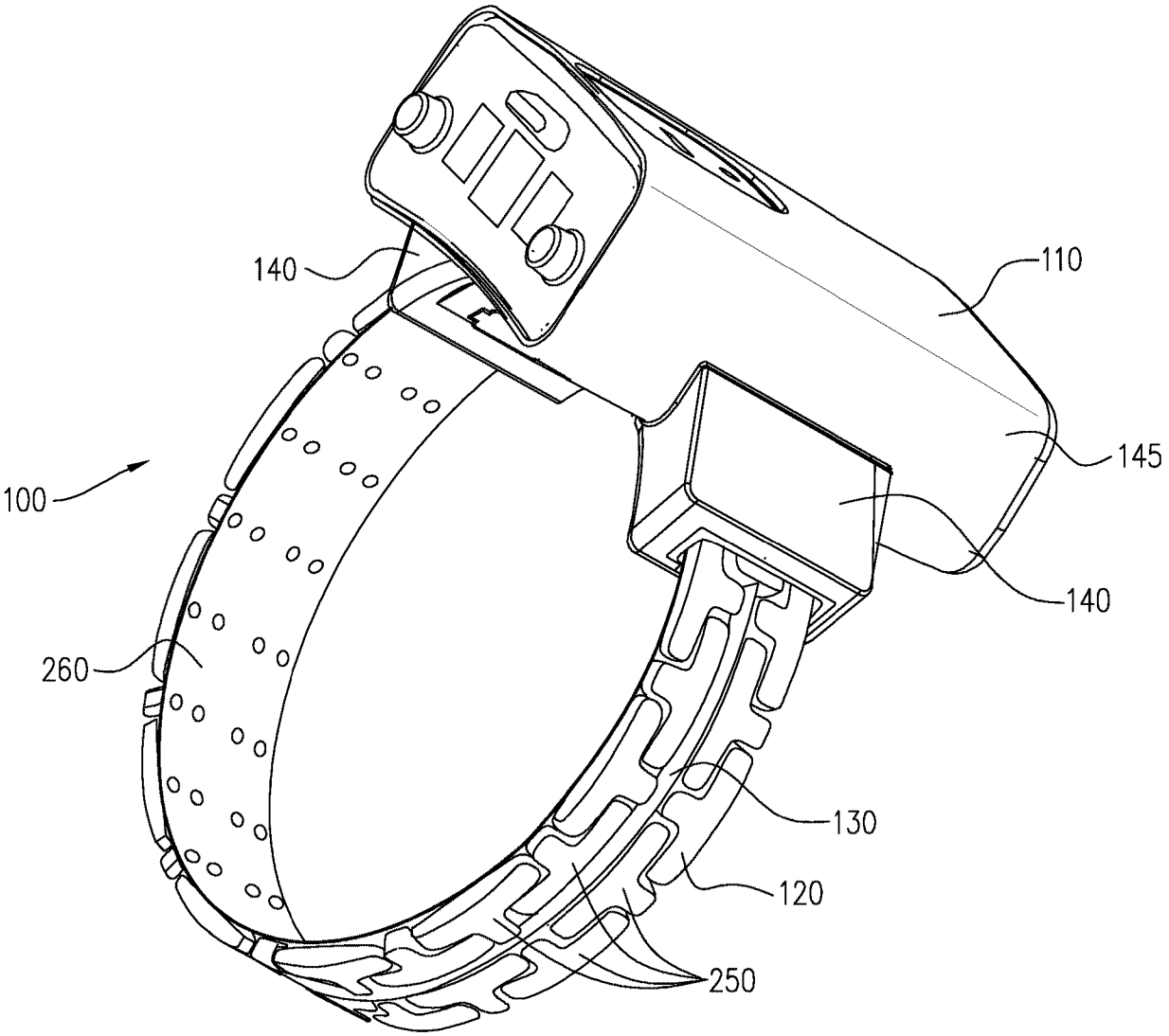
FIG. 1A is a schematic illustration of a perspective view of a first side of a tracking device, according to an exemplary embodiment of the disclosure.
Figure 1C:
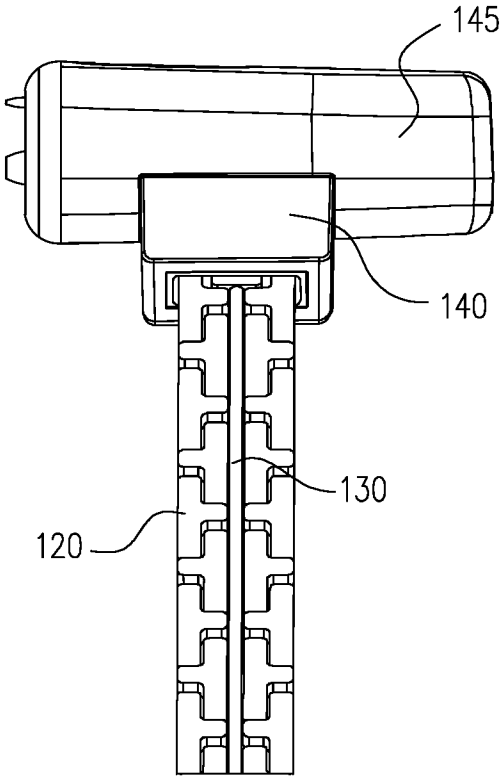
FIG. 1C is a schematic illustration of a side view of a tracking device, according to an exemplary embodiment of the disclosure.
Figure 1B:
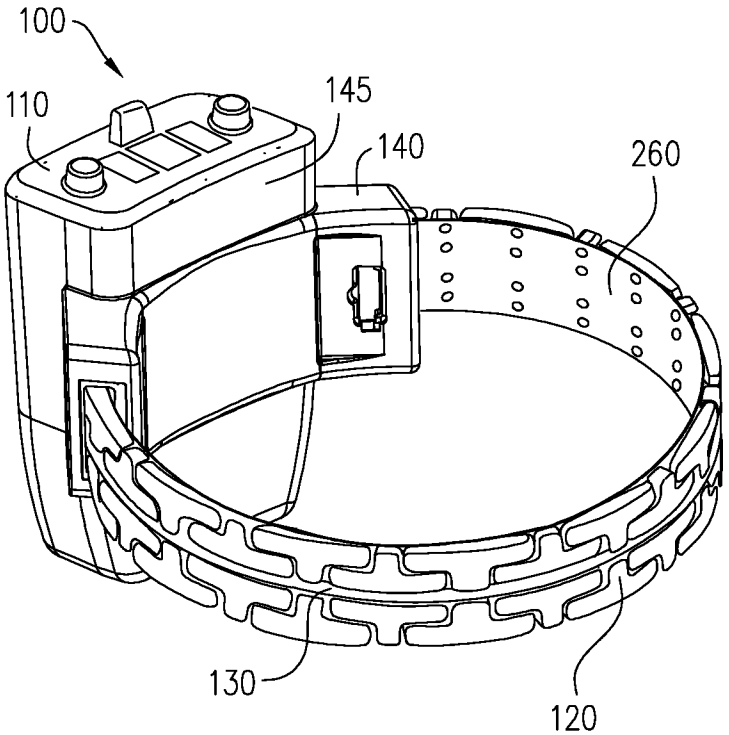
FIG. 1B is a schematic illustration of a perspective view of a second side of a tracking device, according to an exemplary embodiment of the disclosure.

FIG. 1A is a schematic illustration of a perspective view of a first side of a tracking device 100 and FIG. 1B is a schematic illustration of a perspective view of a second side of a tracking device 100, according to an exemplary embodiment of the disclosure. Tracking device 100 includes a communication interface 110 that may serve as a GPS tracking device and/or a transmitter/receiver that communicates with a base station or directly with a central server. In some embodiments of the disclosure, the communication interface serves as a transceiver (transmitter/receiver) and in some embodiments the communication interface may serve only as a transmitter or only as a receiver.

In an exemplary embodiment of the disclosure, the tracking device 100 also includes a flexible strap 120 that is configured to securely couple the communication interface 110 to a limb of a person, for example an ankle or wrist. Optionally, the strap 120 may be provided in the form of a strap 220 (e.g. FIG. 2B) that is made up from a single elongated flexible thin sheet 260 of a strong material (e.g. stainless steel or strong plastic) coupled to links 250 guiding a fiber optic cable 130 between the links 250. The strap 120 is designed to serve as a reusable robust flexible strap 120 that cannot be cut with household tools or optionally even with a bolt cutter or wire cutter. Alternatively, the strap 120 may be provided in the form of a strap 320 (e.g. FIG. 3B) that is made up from two or more elongated thin sheets of flexible material 360 coupled to links 350 holding the sheets together and wherein the fiber optic cable 130 is positioned between the sheets 360 below the links 350. Optionally, the links (250, 350) are thicker than the thin sheets (260, 360).

In an exemplary embodiment of the disclosure, the communication interface 110 of the tracking device 100 identifies its location and communicates the identified location to the central server to enable monitoring the location of the person wearing the tracking device 100. Optionally, the tracking device 100 also monitors that it is coupled to the person's limb and has not been tampered with or removed. In an exemplary embodiment of the disclosure, the fiber optic cable 130 embedded within the strap 120 is used to monitor and detect tampering. For example the fiber optic cable 130 serves to transmit a light signal from the first side of the communication interface 110 to the second side to verify that the strap 120 is intact, has not been tampered with and remains securely locked around the person's limb.

Figure 1E:
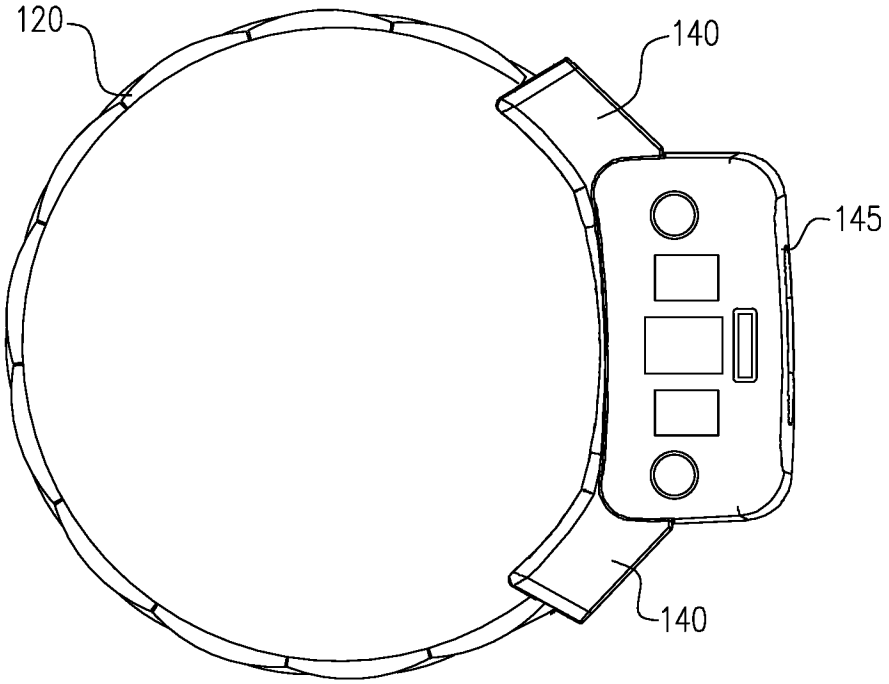
FIG. 1E is a schematic illustration of an upper view of a tracking device, according to an exemplary embodiment of the disclosure.
Figure 1D:
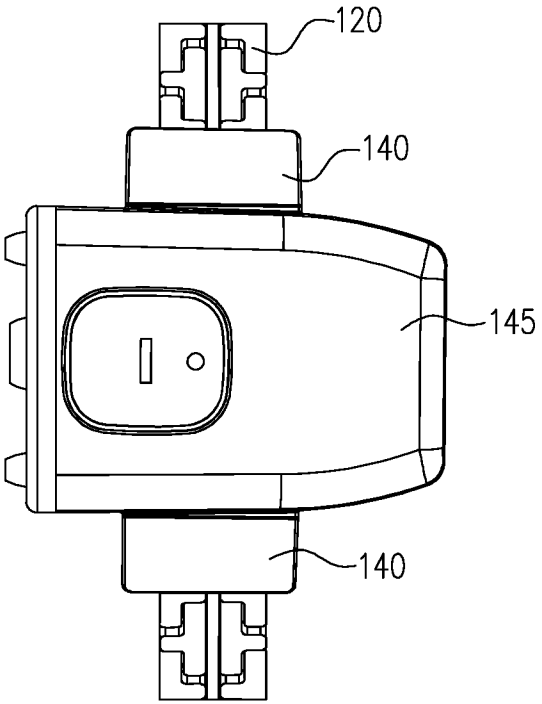
FIG. 1D is a schematic illustration of a front view of a tracking device, according to an exemplary embodiment of the disclosure.

FIG. 1C is a schematic illustration of a side view of tracking device 100, FIG. 1D is a schematic illustration of a front view of tracking device 100 and FIG. 1E is a schematic illustration of an upper view of tracking device 100, according to an exemplary embodiment of the disclosure. Optionally, the straps 120 are premanufactured in various sizes and not cut to size and prepared on the spot to fit a specific person. In some embodiments of the disclosure, the straps 120 are color coded to designate the size of the strap 120. In an exemplary embodiment of the disclosure, when installing the strap 120 the installer arrives with a set of straps 120 and selects a correct sized strap 120 to fit the limb of the person that the tracking device 100 is being attached to. Optionally, when removing the strap 120 it may be cleaned and restocked for future use on a different person.

Figure 2A:
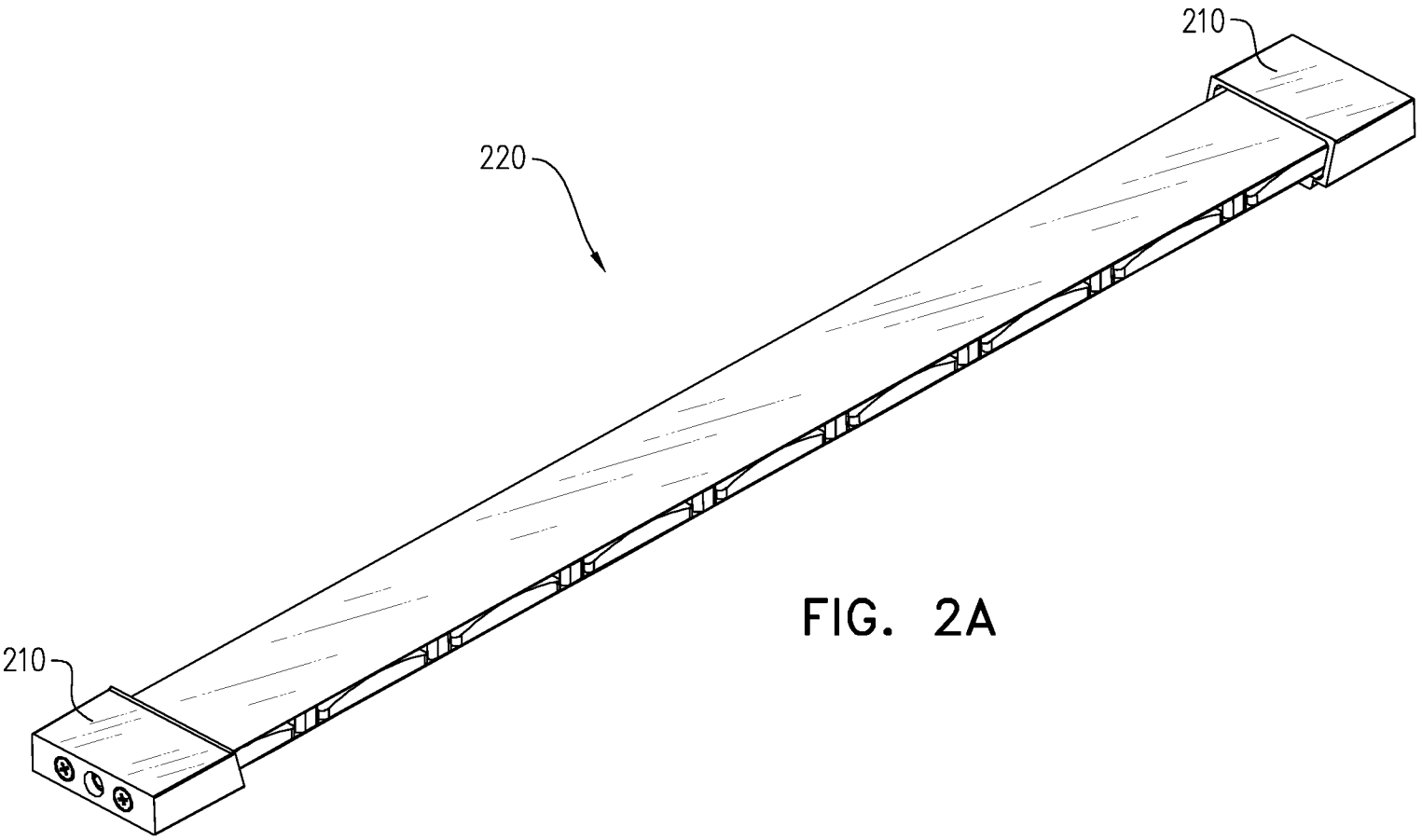
FIG. 2A is a schematic illustration of a strap, according to an exemplary embodiment of the disclosure.
Figure 2B:
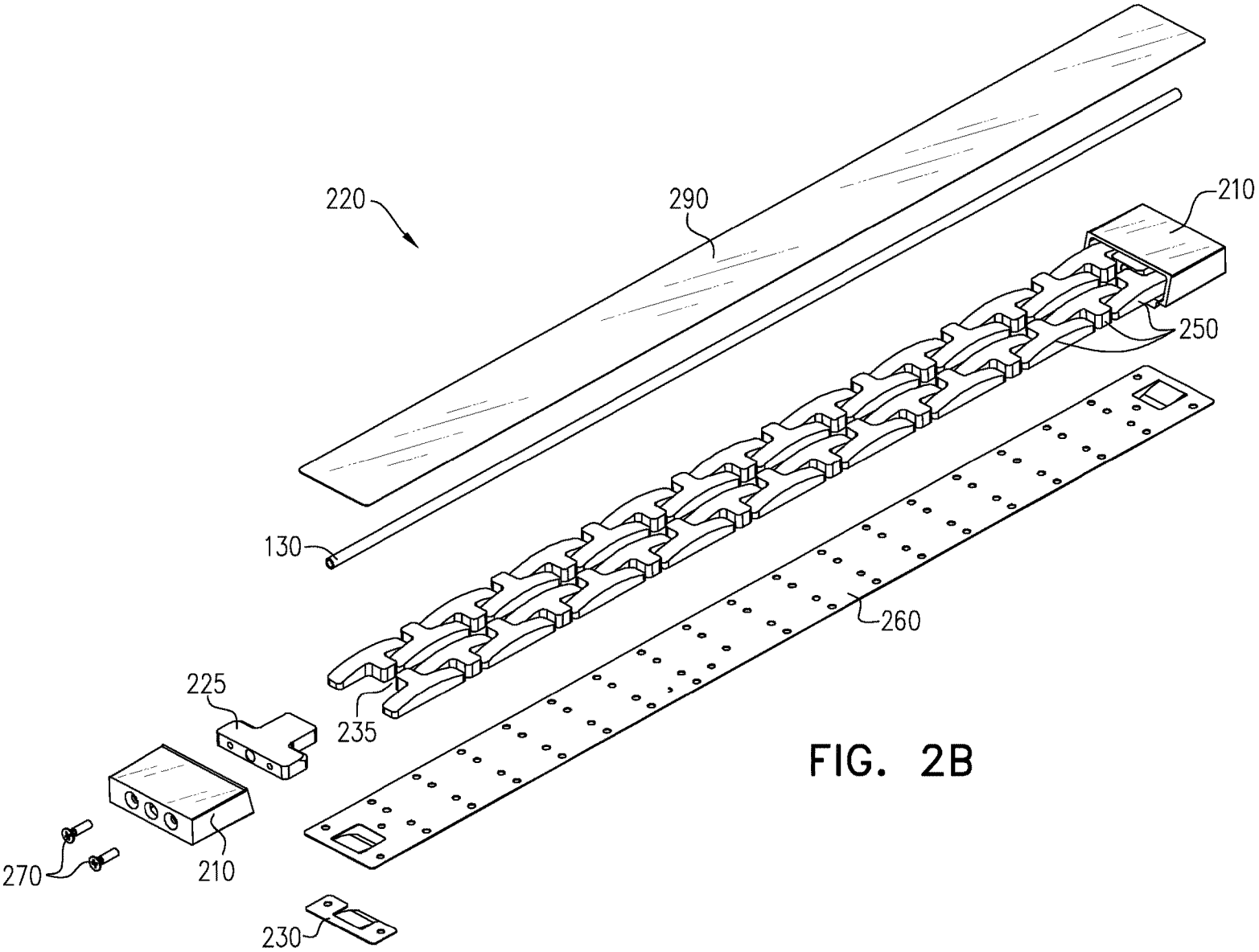
FIG. 2B is a schematic illustration of an exploded view of a strap, according to an exemplary embodiment of the disclosure.
Figure 2C:
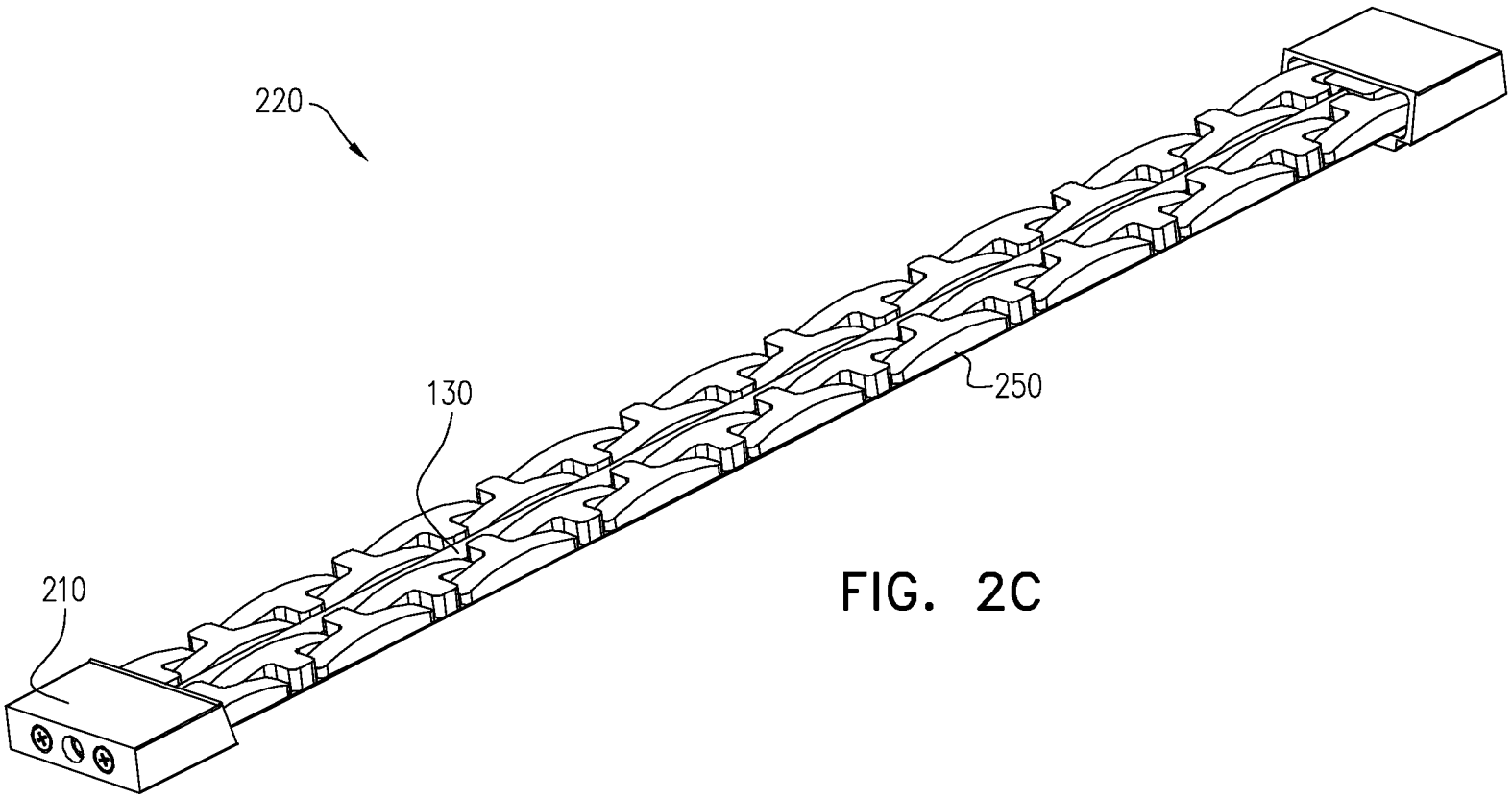
FIG. 2C is a schematic illustration of a perspective back view of a strap, according to an exemplary embodiment of the disclosure.

FIG. 2A is a schematic illustration of strap 220, FIG. 2B is a schematic illustration of an exploded view of strap 220 and FIG. 2C is a schematic illustration of a perspective back view of strap 220, according to an exemplary embodiment of the disclosure. In an exemplary embodiment of the disclosure, communication interface 110 is enclosed in an enclosure 145 and includes on each side a receptacle 140 to grasp the strap 220. Optionally, each end of the strap 220 is fit with a head 210 that is configured to lock an end of strap 220 into one of the receptacles 140. In an exemplary embodiment of the disclosure, each head 210 includes an interface 225 for connecting with the ends of fiber optic cable 130. Optionally, interface 225 is configured to connect with an optical circuit within the enclosure of communication interface 110 and form an optical connection between the sides of the tracking device 100. Optionally, the interface 225 is attached with screws 270 to head 210 and coupled to sheet 260 in a similar manner as the links 250. Additionally, each head 210 may include a latch 230 that is configured to make head 210 snap into the receptacle 140, locking the head 210 in place and preventing it from sliding back out. Optionally, a special tool is required to press on latch 230 and release strap 220 from receptacle 140.

In an exemplary embodiment of the disclosure, the links 250 are coupled to the thin sheet 260, for example using an adhesive, screws or by welding (e.g. laser welding). Optionally, the links 250 are arranged in two rows along the elongated axis of sheet 260, leaving a channel 235 for placing fiber optic cable 130 between the links 250 above sheet 260. Accordingly, the links 250 provide strength to strap 220 and protect fiber optic 130, while maintaining flexibility.

In an exemplary embodiment of the disclosure, strap 220 is covered by a protective cover 290. The cover is made from a flexible material such as silicon, rubber, plastic and/or other materials e.g. biocompatible materials. In some embodiments of the disclosure, the cover 290 covers a single side of strap 220, for example the outer circumference of the strap 220 when attached to communication interface 110. Alternatively, protective cover 290 may cover strap 220 on two sides, for example the outer circumference and inner circumference of strap 220, or completely enclose the strap 220 along the length of the strap 220.

Figure 3A:
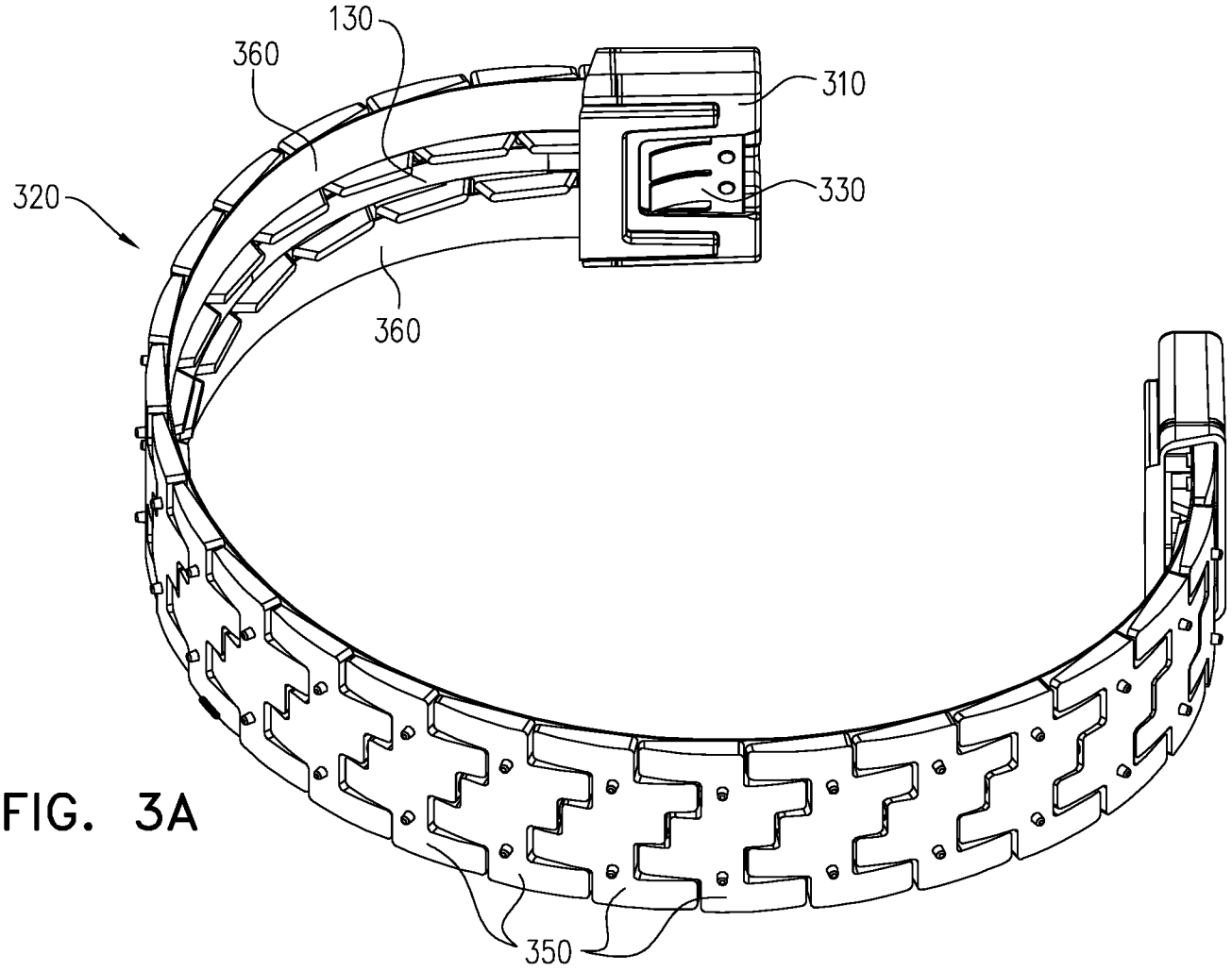
FIG. 3A is a schematic illustration of an alternative strap, according to an exemplary embodiment of the disclosure.
Figure 3B:
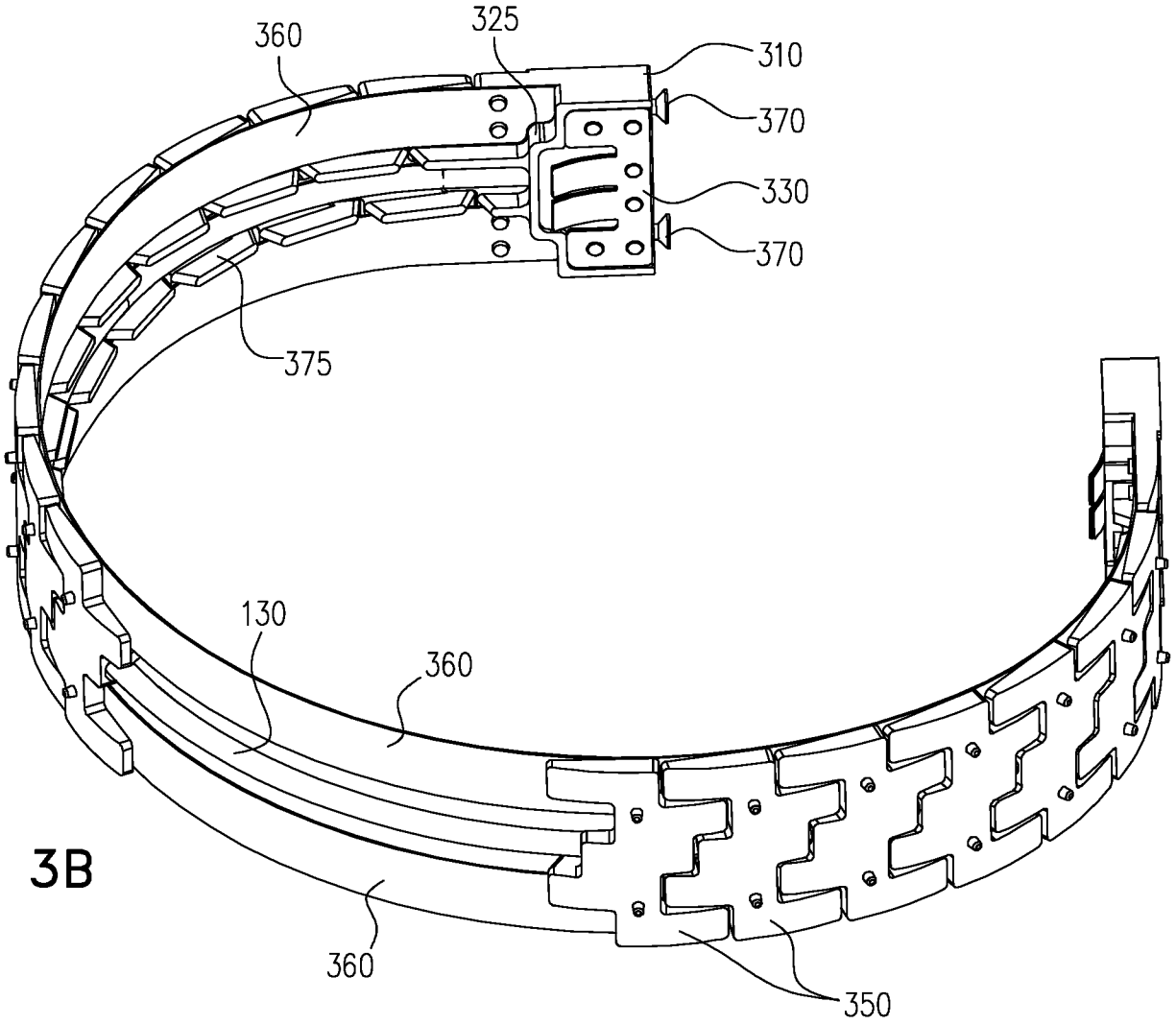
FIG. 3B is a schematic illustration of an alternative strap with cut out portions, according to an exemplary embodiment of the disclosure.
Figure 3C:
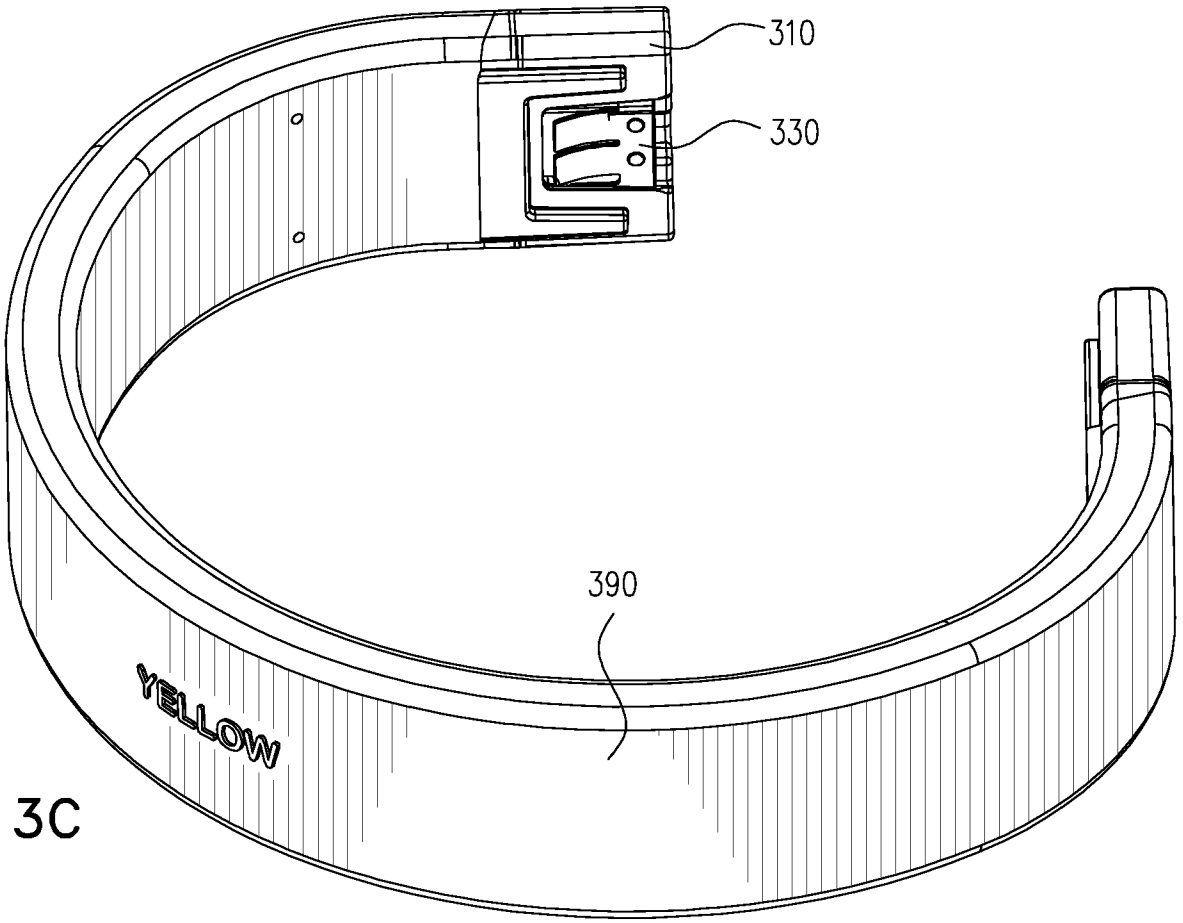
FIG. 3C is a schematic illustration of an alternative strap with a protective coating, according to an exemplary embodiment of the disclosure.

FIG. 3A is a schematic illustration of an alternative strap 320, FIG. 3B is a schematic illustration of alternative strap 320 with cut out portions and FIG. 3C is a schematic illustration of alternative strap 320 with a protective coating 390, according to an exemplary embodiment of the disclosure.

Strap 320 is similar to strap 220. Both include a head (310, 210) with a latch (330, 230), screws (370, 270) and an interface (325, 225) for locking the strap (320, 220) in receivers 140. However as shown in FIGS. 3A to 3C strap 320 may comprise links 350 in the form of single interlinking elements each covering the entire width of the strap 320. Likewise strap 320 comprises multiple sheets 360 that cover the entire length of the strap 320 and are held together by being coupled to the links 350. In an exemplary embodiment of the disclosure, the fiber optic cable 130 is positioned under the links 350 between the multiple sheets along the inner circumference of strap 320 to reduce stress on the fiber optic cable 130. Alternatively, the links 350 may be attached along the inner circumference of the strap 320 and the sheets 360 along the outer circumference of strap 320, with fiber optic cable 130 positioned along the outer circumference.

In contrast to strap 320, in strap 220 the sheet 260 covers the entire width of the strap 220 and the links 250 are coupled to the sheet leaving a channel 235 for placing the fiber optic cable 130 between the links 250. The links 250 are placed next to each other to cover the entire length of the strap 220.

In an exemplary embodiment of the disclosure, the links (350, 250) are not directly connected together but rather only positioned next to each other (e.g. in an interlocking pattern) and coupled to the sheets (360, 260) to form a robust flexible strap (320, 220) that can be bent to fit around the person's limb.

In an exemplary embodiment of the disclosure, links 350 include protection tabs 375 that extend downward from the links 350 (toward the inner circumference) to form a protected channel for the fiber optic cable 130 between the multiple sheets 360.

In some embodiments of the disclosure, head 330 includes interface 325, thus head 330 is connected directly to sheet 360 instead of indirectly via interface 325.

In some embodiments of the disclosure, the sheets (260, 360) and links (250, 350) are made from stainless steel. Alternatively, they may be made from other materials, for example metals or plastics (e.g. polycarbonate). Optionally, the materials may be rigid and lightweight so that the tracking device 100 is less of a burden on the person to which it is attached.

It should be appreciated that the above described methods and apparatus may be varied in many ways, including omitting or adding steps, changing the order of steps and the type of devices used. It should be appreciated that different features may be combined in different ways. In particular, not all the features shown above in a particular embodiment are necessary in every embodiment of the disclosure. Further combinations of the above features are also considered to be within the scope of some embodiments of the disclosure. It will also be appreciated by persons skilled in the art that the present disclosure is not limited to what has been particularly shown and described hereinabove but rather will be defined by the claims.

I claim:

1. A tracking device, comprising:

a communication interface encased in an encasement with a receptacle on two opposite sides of the encasement;

a strap, comprising:

one or more thin elongated flexible sheets;

links coupled to one side of the one or more thin elongated flexible sheets;

a fiber optic cable extending from a first end of the one or more thin elongated flexible sheets to a second end of the one or more thin elongated flexible sheets;

a head connected to each end of the one or more thin elongated flexible sheets; wherein the heads are configured to fit into the receptacles and lock the strap in the receptacles thus preventing the strap from sliding out of the receptacles;

wherein the communication interface is configured to detect tampering with the strap by transmitting an optical signal through the fiber optic cable; and wherein the strap includes a single thin elongated flexible sheet and the links are arranged in two rows along an elongated axis of the thin elongated flexible sheet, forming a channel between the two rows for placing the fiber optic cable between the links.

2. The device according to claim 1, wherein the strap further includes an interface connected at each end of the fiber optic cable; wherein the interface at each end is coupled to the ends of the one or more thin elongated flexible sheets and attached to a respective head.

3. The device according to claim 1, wherein the head at each end of the strap is coupled directly to the ends of the one or more thin elongated flexible sheets.

4. The device according to claim 1, wherein each head includes a latch that is configured to lock the head in the receptacle and wherein the latch is configured to also enable release of the head from the receptacle by pressing on the latch with a specially designed tool.

5. The device according to claim 1, wherein the links of the strap are covered by a protective cover.

6. The device according to claim 5, wherein the protective cover is color coded to designate a length of the strap.

7. A tracking device, comprising:

a communication interface encased in an encasement with a receptacle on two opposite side of the encasement;

a strap, comprising:

one or more thin elongated flexible sheets;

links coupled to one side of the one or more thin elongated flexible sheets;

a fiber optic cable extending from a first end of the one or more thin elongated flexible sheets to a second end of the one or more thin elongated flexible sheets;

a head connected to each end of the one or more thin elongated flexible sheets; wherein the heads are configured to fit into the receptacles and lock the strap in the receptacles thus preventing the strap from sliding our of the receptacles;

wherein the communication interface is configured to detect tampering with the strap by transmitting an optical signal through the fiber optic cable; and wherein the strap includes multiple thin elongated flexible sheets; wherein each link defines the width of the strap and is coupled to each of the multiple thin elongated flexible sheets; and wherein the links are interlocked along an elongated axis of the multiple thin elongated flexible sheets.

8. The device according to claim 3, wherein the links include protection tabs that extend downward from the links toward the inner circumference of the strap to form a protected channel for the fiber optic cable between the multiple thin elongated flexible sheets.

9. The device according to claim 3, wherein the fiber optic cable is positioned below the links toward the inner circumference of the strap between the multiple thin elongated flexible sheets.

10. A method of connecting a tracking device to a limb of a person, comprising:

receiving a communication interface encased in an encasement with a receptacle on two opposite sides of the encasement;

receiving a strap, comprising:

one or more thin elongated flexible sheets;

links coupled to one side of the one or more thin elongated flexible sheets;

a fiber optic cable extending from a first end of the thin elongated flexible sheets to a second end of the thin elongated flexible sheets;

a head connected to each end of the thin elongated flexible sheets;

inserting the heads of the strap into the receptacles of the communication interface to lock the straps to the communication interface and prevent the straps from sliding out of the receptacles;

wherein the communication interface is configured to detect tampering with the strap by transmitting an optical signal through the fiber optic cable; and wherein the strap includes a single thin elongated flexible sheet and the links are arranged in two rows along an elongated axis of the thin elongated flexible sheet, forming a channel between the two rows for placing the fiber optic cable between the links.

11. The method according to claim 10, wherein the strap further includes an interface connected at each end of the fiber optic cable; wherein the interface at each end is coupled to the ends of the multiple thin elongated sheets and attached to a respective head.

12. The method according to claim 10, wherein the head at each end of the strap is coupled directly to the ends of the multiple thin elongated sheets.

13. The method according to claim 10, wherein each head includes a latch that is configured to lock the head in the receptacle and wherein the latch is configured to also enable release of the head from the receptacle by pressing on the latch with a specially designed tool.

14. The method according to claim 10, wherein the links of the strap are covered by a protective cover.

15. The method according to claim 14, wherein the protective cover is color coded to designate a length of the strap.

16. A method of connecting a tracking device to a limb of a person, comprising:

receiving a communication interface encased in an encasement with a receptacle on two opposite sides of the encasement;

receiving a strap, comprising:

one or more thin elongated flexible sheets;

links coupled to one side of the one or more thin elongated flexible sheets;

a fiber optic cable extending from a first end of the thin elongated flexible sheets to a second end of the thin elongated flexible sheets;

a head connected to each end of the thin elongated flexible sheets;

inserting the heads of the strap into the receptacles of the communication interface to lock the straps to the communication interface and prevent the straps from sliding out of the receptacles;

wherein the communication interface is configured to detect tampering with the strap by transmitting an optical signal through the fiber optic cable; and wherein the strap includes multiple thin elongated flexible sheets; wherein each link defines the width of the strap and is coupled to each of the multiple thin elongated flexible sheets; and wherein the links are interlocked along an elongated axis of the multiple thin elongated flexible sheets.

17. The method according to claim 13, wherein the links include protection tabs that extend downward from the links toward the inner circumference of the strap to form a protected channel for the fiber optic cable between the multiple thin elongated flexible sheets.

18. The method according to claim 13, wherein the fiber optic cable is positioned below the links toward the inner circumference of the strap between the multiple thin elongated sheets.

* * * * *